United States Patent [19]

Mancini

[11] Patent Number: 4,656,853

[45] Date of Patent: Apr. 14, 1987

[54] KEY HOLDER CONSTRUCTION

[76] Inventor: William D. Mancini, 145 Claypool Dr., Warwick, R.I. 02886

[21] Appl. No.: 871,084

[22] Filed: Jun. 5, 1986

[51] Int. Cl.[4] ..... A47G 29/10

[52] U.S. Cl. ..... 70/456 R; 24/3 K; 70/459; 206/37.5; 206/37.8

[58] Field of Search ..... 70/456 R, 457–459; 7/169, 170; 59/93; 206/37.1, 37.5, 37.6, 37.8; D3/61, 62; 24/3 K, 238, 654, 598

[56] References Cited

U.S. PATENT DOCUMENTS

| | | | |
|---|---|---|---|
| 785,399 | 3/1905 | Brandt | 70/457 |
| 1,183,812 | 5/1916 | Gillespie | 70/457 |
| 1,626,987 | 5/1927 | Venegas . | |
| 2,224,073 | 12/1940 | Augenstein . | |
| 2,633,012 | 3/1953 | Johnstone . | |
| 2,855,775 | 10/1958 | Marien . | |
| 3,362,201 | 1/1968 | Lachin . | |
| 3,635,058 | 1/1972 | Polk . | |
| 4,129,021 | 12/1978 | Breutini . | |
| 4,324,121 | 4/1982 | Richter . | |
| 4,422,315 | 12/1983 | Klose | 70/456 R |

FOREIGN PATENT DOCUMENTS

| | | | |
|---|---|---|---|
| 0070599 | 1/1983 | European Pat. Off. | 24/3 K |
| 1175929 | 8/1964 | Fed. Rep. of Germany | 70/459 |
| 1481078 | 4/1967 | France | 70/458 |
| 455993 | 3/1950 | Italy | 70/459 |
| 614224 | 12/1960 | Italy | 70/459 |

*Primary Examiner*—Robert L. Wolfe
*Assistant Examiner*—Lloyd A. Gall
*Attorney, Agent, or Firm*—Salter & Michaelson

[57] ABSTRACT

A key holder is disclosed which comprises a substantially planar body portion, a substantially circular ring having an open gap therein and rotatably mounted in substantially coplanar relation on the body portion, and a resilient tongue on the body portion. The ring is rotatable between a closed position wherein the open gap faces inwardly toward the body portion, and an open position wherein the open gap faces outwardly to permit the insertion of a key or the like on the ring. When the ring is in the closed position, the tongue normally extends into the gap to prevent the ring from being rotated. However, the tongue is resiliently deflectable away from the plane of the body portion to permit the ring to be rotated to the open position.

7 Claims, 5 Drawing Figures

KEY HOLDER CONSTRUCTION

BACKGROUND AND SUMMARY OF THE INVENTION

The instant invention relates to holders for keys and more particularly to a novel key holder which is highly effective, simple to operate, and adapted to be embodied in a variety of different aesthetically pleasing configurations.

A variety of different types of key holders of the type which are adapted for holding one or more keys on a ring have been heretofore available. In this regard, probably the most common key holder of this general type which has been heretofore available comprises a ring made of a resilient, helically wound metal element, wherein the opposite ends of the metal element are resiliently separable from the adjacent portions of the metal element to enable a key or the like to be inserted onto the ring. Another key holder of this general type which has been heretofore available comprises a circular ring having an opening portion which is hingeable to an open position to permit the insertion of a key thereon. Still other holders of this general type which represent the closest prior art to the subject invention of which the applicant is aware are disclosed in the U.S. patents to Venegas U.S. Pat. No. 1,626,987; Augenstein U.S. Pat. No. 2,224,073; Johnstone U.S. Pat. No. 2,633,012; Marien U.S. Pat. No. 2,855,775; Lachin U.S. Pat. No. 3,362,201; Polk U.S. Pat. No. 3,635,058; Brentini U.S. Pat. No. 4,129,012; and Richter U.S. Pat. No. 4,324,121. However, while these patents disclose a variety of different types of key holder constructions, they fail to teach the novel and simple structural features of the key holder of the instant invention, and hence they are believed to be of only general interest.

The instant invention provides a novel key holder which is both highly effective and simple to operate. Specifically, the key holder of the instant invention comprises a planar body portion which is preferably made of any suitable resilient flat material, a substantially circular ring having an open gap therein which is rotatably mounted on the body portion in substantially coplanar relation therewith, and a resilient tongue which is preferably integrally formed on the body portion. The ring is oriented so that it is rotatable on the body portion between a closed or first position wherein an uninterrupted portion of the ring projects outwardly from the body portion to define a closed loop on the key holder and an open or second position wherein at least a portion of the gap in the ring is disposed outwardly from the body portion to permit the insertion of a key or the like on the ring. The tongue is preferably oriented on the body portion so that when the ring is in the closed position thereof, the tongue is substantially coplanar with the body portion and extends into the gap to prevent the ring from rotating. The tongue is, however, resiliently deflectable away from the plane of the body portion to remove it from the gap so that the ring can be rotated to the open position thereof. The tongue and the body portion are preferably integrally formed from a suitable resilient sheet metal, such as brass, the body portion preferably has a circular notch formed at one end thereof, and the ring is preferably rotatably mounted in the notch. Further, the ring is preferably formed with an outwardly facing annular groove therein, and the portion of the body portion which defines the circular notch is preferably received in the annular groove for rotatably mounting the ring on the body portion.

In order to install a key on the key holder of the instant invention, the tongue is resiliently deflected outwardly so that it is removed from the gap. This enables the ring to be rotated to the open or second position thereof wherein the gap is spaced outwardly from the body portion to permit access thereto so that one or more keys or the like can be inserted onto the ring. After the keys have been installed on the ring, the ring can be further rotated to return it to the closed position thereof; and as soon as it reaches the closed position, the resilient tongue is automatically received in the gap to prevent the ring from being rotated further. When the tongue and the ring are positioned in this manner, the ring can be effectively utilized for retaining the keys thereon; and since the tongue prevents the ring from being rotated to an open position, the keys are effectively retained on the key holder.

Accordingly, it is a primary object of the instant invention to provide an effective key holder having a relatively simple construction.

Another object of the instant invention is to provide a key holder comprising a base portion having a resilient tongue integrally formed thereon and a ring which is rotatably mounted on the base portion, wherein the tongue is receivable in a gap in the ring for preventing rotation thereof to an open position.

A still further object of the instant invention is to provide a key holder comprising a body portion, a ring rotatably mounted on the body portion, and a tongue which is deflectable outwardly from the plane of the body portion to permit rotation of the ring.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
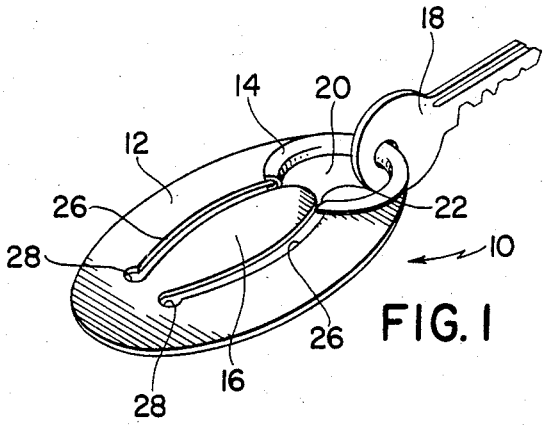
FIG. 1 is a perspective view of the key holder of the instant invention with the ring in the closed position and with a key received thereon.

Referring now to the drawing, the key holder of the instant invention is illustrated in FIGS. 1 through 5 and generally indicated at 10. The key holder 10 comprises a body portion 12, a ring 14, and a resilient tongue 16, and it is operative for receiving and retaining key 18 on the ring 14 in the manner illustrated as will be hereinafter set forth.

The body portion 12 is preferably of substantially planar configuration and it is preferably formed from a suitable resilient material, such as plastic, brass, aluminum, steel or a suitable metal alloy. The body portion 12 is preferably formed with a substantially circular open notch 20 at one end thereof which preferably extends through an arc of greater than 180°, whereas the body portion 12 as herein embodied has a substantially oval-shaped peripheral configuration.

The ring 14 is also made of a suitable metal or plastic material, and it is preferably formed in a substantially circular configuration, although it has a gap 22 which defines an interrupted or open portion of the ring 14. The ring 14 is preferably further formed with an outwardly facing annular channel or groove 24 therein, and it is rotatably received in the opening 20. In this regard, the ring 14 and the notch 20 are dimensioned so that when the ring is received in the notch 20 the portions of the body portion 12 which are adjacent the notch 20 extend into the groove 24 for rotatably securing the ring 14 on the body portion 12. Further, since the notch 20 preferably extends through an arc of greater than 180°, the portions of the body portion 12 which are adjacent the ring 14 extend more than half way around the ring 14 to rotatably secure it on the body 12.

The tongue 16 is preferably integrally formed with the body portion 12 in the interior thereof. The sides of the tongue 16 are defined by slots 26 which extend inwardly into the body portion 12 from the notch 20 and have substantially circular openings 28 at the inner ends thereof, and the tongue 16 is formed in an elongated configuration, terminating in a terminal end portion 30. The tongue 16 is preferably constructed so that it is normally biased to a position wherein it is substantially coplanar with the body portion 12, but so that it is resiliently deflectable away from the plane of the body portion 12. Further, the tongue 16 is positioned on the body portion 12 so that the terminal end portion 30 projects into the notch 20 when the tongue 16 is in substantially coplanar relation with the body portion 12. The terminal end portion 30 is dimensioned so that when the gap 22 is aligned with the terminal end portion 30, the terminal end portion 30 is receivable in the gap 22 for preventing rotation of the ring 14.

Figure 2:
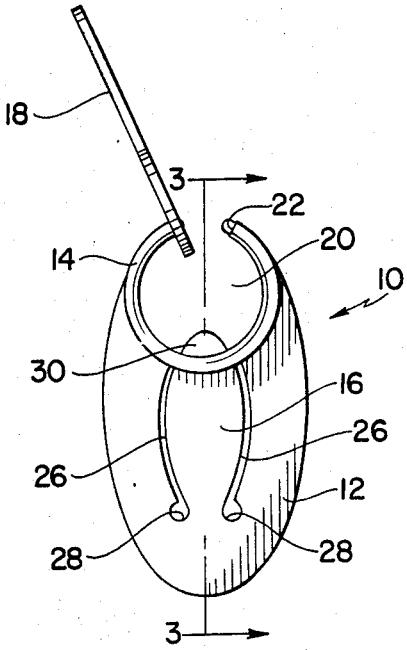
FIG. 2 is a plan view of the key holder with the ring in the open position illustrating the installation of a key thereon.
Figure 3:
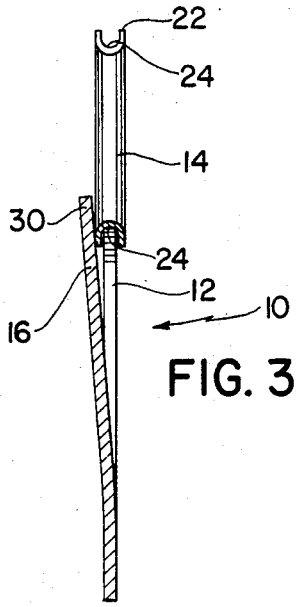
FIG. 3 is a sectional view taken along line 3—3 in FIG. 2.
Figure 4:
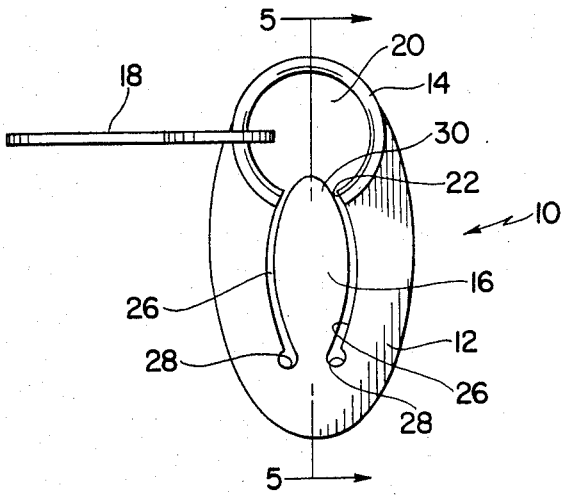
FIG. 4 is a plan view of the key holder with the ring in the closed position and with a key received thereon.
Figure 5:
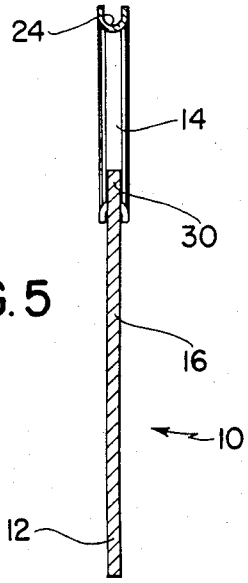
FIG. 5 is a sectional view taken along line 5—5 in FIG. 4.

During use and operation of the key holder 10, keys, such as the key 18, can be simply and easily assembled onto and removed from the ring 14 when the ring 14 is in the open position thereof illustrated in FIGS. 2 and 3, and they are effectively retained on the ring 14 when the ring 14 is in the closed position thereof illustrated in FIGS. 1, 4 and 5. In this connection, when the ring 14 is in the closed position, an uninterrupted portion thereof projects outwardly from the body portion 12 to define a closed loop on one end of the key holder 10. Further, when the ring 14 is in this position, the terminal end portion of the tongue 16 extends into the gap 22 to prevent rotation of the ring 14. However, by deflecting the tongue 16 outwardly from the plane of the body portion 12 so that the terminal end portion 30 is removed from the gap 22, the ring 14 can be rotated to the open position illustrated in FIGS. 2 and 3 wherein the gap 22 is disposed outwardly beyond the end of the body portion 12 to permit a key, such as the key 18, to be installed onto the ring 14. Thereafter, by rotating the ring 14 to the closed position illustrated in FIGS. 1, 4 and 5, the key 18 can be effectively releasably secured on the key holder 10. In this regard, as the ring 14 is rotated to the closed position, the terminal end portion 30 of the tongue 16 rides on the surface of the ring 14 until the gap 22 is aligned with the terminal end portion 30, whereupon the tongue 16 is resiliently returned to a position wherein it is substantially coplanar with the body portion 12, and wherein it is received in the gap 22 to prevent the ring 14 from being rotated further.

It is seen, therefore, that the instant invention provides a highly effective and novel key holder. The key holder 10 is simple and easy to operate, and it can be effectively utilized for detachably securing one or more keys, such as the key 18, thereon. In addition, because of the unique operation of the key holder 10, it has a high degree of appeal and a high level of commercial potential. Accordingly, it is seen that the key holder of the instant invention represents a significant advancement in the art which has substantial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A key holder comprising:

a. a substantially planar body portion;

b. a substantially circular ring having an open gap therein rotatably mounted on said body portion in substantially coplanar relation therewith, said ring being oriented on said body portion so that it is rotatable between a closed position wherein an uninterrupted portion of said ring projects outwardly from said body portion to define a closed loop on said key holder and said gap is disposed in a predetermined inwardly facing position with respect to said body portion and an open position wherein at least a portion of said gap is disposed outwardly from said body portion to permit the insertion of a key or the like on said ring; and c. a resilient tongue on said body portion, said tongue being oriented so that when said ring is in said closed position said tongue is substantially coplanar with said body portion and extends into said gap to lock said ring in said closed position thereof, said tongue being deflectable away from the plane of said body portion to remove it from said gap and to thereby permit said ring to be rotated to said open position thereof.

2. In the key holder of claim 1, said tongue being integrally formed with said body portion.

3. In the key holder of claim 2, said tongue and said body portion being made of a sheet metal.

4. In the key holder of claim 1, said body portion having an arucate notch at one end thereof, said ring being rotatably mounted in said notch.

5. In the key holder of claim 4, said ring having an outwardly facing annular groove therein, the portion of said body portion which defines said notch being received in said annular groove to rotatably mount said ring on said body portion.

6. In the key holder of claim 1, said tongue normally engaging a side of said ring to frictionally resist the free rotation of said ring when said ring is in a position other than said closed position thereof.

7. A key holder comprising:

a. a substantially planar body portion having an open notch formed therein at one end thereof;

b. a substantially circular ring having an open gap therein rotatably mounted in said notch in substantially coplanar relation with said body portion, said ring being oriented on said body portion so that it is rotatable between a closed position wherein an uninterrupted portion of said ring projects outwardly from said body portion to define a closed loop on said key holder and said gap is disposed in a predetermined inwardly facing position with respect to said body portion and an open position wherein at least a portion of said gap is disposed outwardly from said body portion to permit the insertion of a key or the like on said ring; and c. a resilient tongue on said body portion, said tongue being defined by a pair of spaced-apart slots formed in said body portion that communicate with said notch and being oriented so that when said ring is in said closed position said tongue is substantially coplanar with said body portion and extends into said gap to lock said ring in said closed position thereof, said tongue being deflectable away from the plane of said body portion to remove it from said gap and to thereby permit said ring to be rotated to said open position thereof.

* * * * *